US008684762B2

(12) United States Patent
Levi

(10) Patent No.: US 8,684,762 B2
(45) Date of Patent: Apr. 1, 2014

(54) JUNCTION BOX, PARTICULARLY FOR LIGHTING LINES FOR TUNNELS

(75) Inventor: Bruno Levi, Brescia (IT)

(73) Assignee: Palazzoli S.p.A. (IT)

( * ) Notice: Subject to any disclaimer, the term of this patent is extended or adjusted under 35 U.S.C. 154(b) by 108 days.

(21) Appl. No.: 13/394,377

(22) PCT Filed: Sep. 28, 2010

(86) PCT No.: PCT/EP2010/005896

§ 371 (c)(1),
(2), (4) Date: Mar. 6, 2012

(87) PCT Pub. No.: WO2011/042127

PCT Pub. Date: Apr. 14, 2011

(65) Prior Publication Data

US 2012/0164873 A1 Jun. 28, 2012

(30) Foreign Application Priority Data

Oct. 8, 2009 (IT) ..... MI2009A1720

(51) Int. Cl.
*H01R 4/24* (2006.01)

(52) U.S. Cl.
USPC ..... 439/425; 174/50.52; 174/50; 248/906

(58) Field of Classification Search
USPC ..... 174/50.52, 50; 439/425, 403; 248/906
See application file for complete search history.

(56) References Cited

U.S. PATENT DOCUMENTS

| | | | | |
|---|---|---|---|---|
| 5,722,852 | A | 3/1998 | Miek | |
| 5,934,930 | A * | 8/1999 | Camps et al. | 439/425 |
| 6,232,557 | B1 | 5/2001 | Lounsbury et al. | |

FOREIGN PATENT DOCUMENTS

| | | | |
|---|---|---|---|
| DE | 198 54 200 | A1 | 6/2000 |
| DE | 102 51 287 | A1 | 5/2004 |
| EP | 0 817 315 | A1 | 1/1998 |
| EP | 1 848 062 | | 10/2007 |
| RU | 373808 | | 3/1973 |
| WO | WO 94/24725 | A1 | 10/1994 |

* cited by examiner

*Primary Examiner* — Dhirubhai R Patel
(74) *Attorney, Agent, or Firm* — R. Neil Sudol; Henry D. Coleman

(57) ABSTRACT

A junction box particularly for lighting lines for tunnels includes a casing body provided with a cover; the casing body includes an electrical socket; a junction device inside the casing body connects the electrical socket to a pair of power supply wires of a power supply line that is affected by the junction box; the junction device includes one or more insulation displacement contacts; each insulation displacement contact engages a respective power supply wire without cutting it.

8 Claims, 10 Drawing Sheets

JUNCTION BOX, PARTICULARLY FOR LIGHTING LINES FOR TUNNELS

BACKGROUND OF THE INVENTION

The present invention relates to a junction box particularly for lighting lines for tunnels.

As is known, in tunnels, lighting is ensured by a plurality of lamps arranged along the route and powered by means of a power supply line.

At the position of each lamp, the power supply line is interrupted by a junction box, in which a terminal strip connects the power supply wires to a socket for the lamp.

The junction box is provided with a degree of protection that ensures a certain resistance to water and dust.

Conventional junction boxes have drawbacks from the point of view of installation and maintenance.

The installation of a conventional junction box in fact entails cutting the wires of power supply line in order to connect them to the terminal strip.

The operations of cutting and connecting the wires, the application of the gaskets and the closure of the box are time-consuming and laborious, also considering that they are performed in an elevated position by an operator who stands on a trestle.

The junction boxes normally used in tunnels also have a severe drawback from the point of view of safety, because in case of fire they do not ensure continuity of the power supply on the entire line.

That is due essentially to the structure of the terminal strip, which in case of high temperatures melts, causing a short circuit.

In other words, not only is lighting lost in the region of the fire, where of course the lamps are destroyed, but power fails along the entire line and therefore also to the lamps that are distant from the point of the fire.

The shutoff of all the lamps in a tunnel entails that even people who are far from the point that is directly affected by the fire are unable to find the exit.

OBJECTS OF THE INVENTION

The aim of the present invention is to provide a junction box that overcomes the drawbacks of the cited prior art.

Within the scope of this aim, an object of the invention is to provide a junction box that can ensure continuity of the electric power supply even if it is damaged.

Another object of the invention is to provide a junction box that allows an extremely faster and easier installation of the lighting system, greatly reducing the installation times of the box with respect to boxes of conventional type.

Another object is to provide a junction box that has a high degree of protection that ensures a long operating life.

Another object of the present invention is to provide a structure the has simple and reduced maintenance.

Another object of the invention is to provide a versatile box that can be used with power supply wires having a different cross-section.

SUMMARY OF THE INVENTION

This aim and these and other objects that will become better apparent hereinafter are achieved by a junction box particularly for lighting lines for tunnels, comprising a casing body provided with a cover; said body comprises an electrical socket; a junction device inside said casing body connects said electrical socket to a pair of power supply wires of a power supply line at said junction box; said junction box is characterized in that the junction device comprises one or more insulation displacement contacts; each insulation displacement contact engages a respective power supply wire without cutting it.

BRIEF DESCRIPTION OF THE DRAWINGS

Further characteristics and advantages of the invention will become better apparent from the description of preferred but not exclusive embodiments of the invention, illustrated by way of nonlimiting example in the accompanying drawings, wherein.

DETAILED DESCRIPTION

Figure 1:
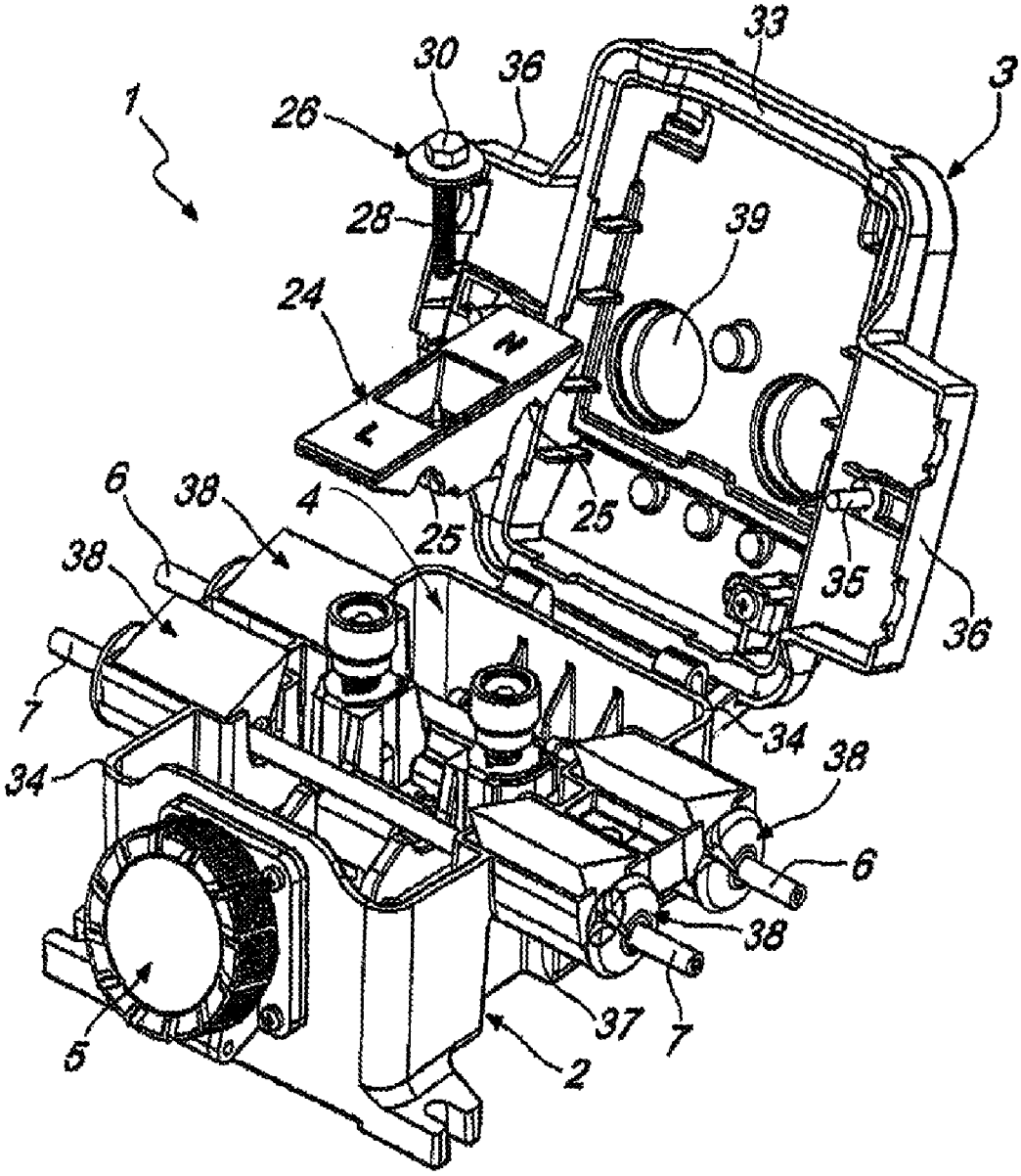
FIG. 1 is a partially exploded perspective view of the junction box according to the present invention, shown with the cover in the open position.

With reference to the cited figures, the device according to the invention, generally designated by the reference numeral 1, comprises a casing body 2 provided with a cover 3 which is hinged to the casing body.

A junction device, generally designated by the reference numeral 4, is provided inside the casing body 2 and connects an electrical socket 5 to a pair of power supply wires 6 and 7.

The junction device 4 has a base 8 preferably made of ceramics and supporting a pair of shaped contacts, respectively 9 and 10.

The contacts 9 and 10 have respective terminals 11 for connection to the socket 5 by means of wires, not shown in the figures.

The contacts 9 and 10 are also connected to respective insulation displacement contacts 12 with the interposition of respective fuses 13. The fuses 13 are inserted in seats provided in the base 8 and are accessible by means of a screw-type knob 14, of a per se known type.

Therefore, the connection between each one of the insulation displacement contacts 12 on the wires 6 and 7 and the socket 5 is performed by means of a fuse 13.

Each insulation displacement contact 12 is preferably constituted by a plurality of spikes 15, which are arranged along the direction of the respective wire 6 and 7 to be connected and are longitudinally mutually offset.

Each spike 15 has a double taper, i.e., a transverse taper 16 and a longitudinal taper 17.

Each insulation displacement contact 12 is arranged in a seat 18 formed by two saddles 19, which are an integral part of the ceramic base 8.

A rubber block 20, which has a central open cavity 21, is inserted in each seat 18 and accommodates an insulation displacement contact 12.

Each rubber block 20 has a pair of side walls 22 blended with transverse walls 23. The transverse walls 23 are more easily deformable than the side walls 22, so that when the wire 6, 7 is pressed against the block 20 the block is deformed centrally, guiding the wire to engage the spikes 15.

The wires 6 and 7 are pressed onto the respective insulation displacement contacts 12 by means of a single presser 24, which is constituted by an element that has two symmetrical concavities 25 that correspond to the position of the wires 6 and 7.

The presser 24 has a single locking screw 26, whose head engages a seat 27 of the presser and whose threaded stem 28 engages a threaded hole 29 in the body 2.

The head of the locking screw 26 has a pre-weakened portion 30, preferably with a hexagonal head or socket, which is adapted to be engaged by an ordinary wrench.

The pre-weakened portion 30 is provided in such a manner that it breaks when the torque applied by means of the wrench during tightening exceeds a selected value, so as to allow correct tightening of the locking screw even without the aid of a torque wrench.

The head of the locking screw comprises a fixed portion 31, which is preferably hexagonal in order to be engaged by a wrench even when the pre-weakened portion 30 has been removed.

The cover 3 is closed hermetically onto the body 2 by the interposition of a gasket 32, which runs along the perimeter of the cover 3 and is accommodated in a perimetric seat 33 in such a manner as to be compressed by an edge 34 of the body 2, when the cover is locked on the body by means of two closure screws 35.

The closure screws 35 are provided in two wings 36 of the cover 3, which correspond to two wings 37 of the body 2 to form a pair of seats for a corresponding number of gaskets 38 of the wires.

The gaskets 38 wrap around both the exit and entry sections of the wires 6 and 7 in the casing body and are locked on the wires by tightening the closure screws 35.

The cover 3 has a cap 39, which can be locked on the cover 3 with screws 40, and allows to access the knobs 14 of the fuses 13 in order to optionally replace them without necessarily removing the cover 3 to open the box 1.

The operation of the junction box according to the present invention is as follows.

Figure 2:
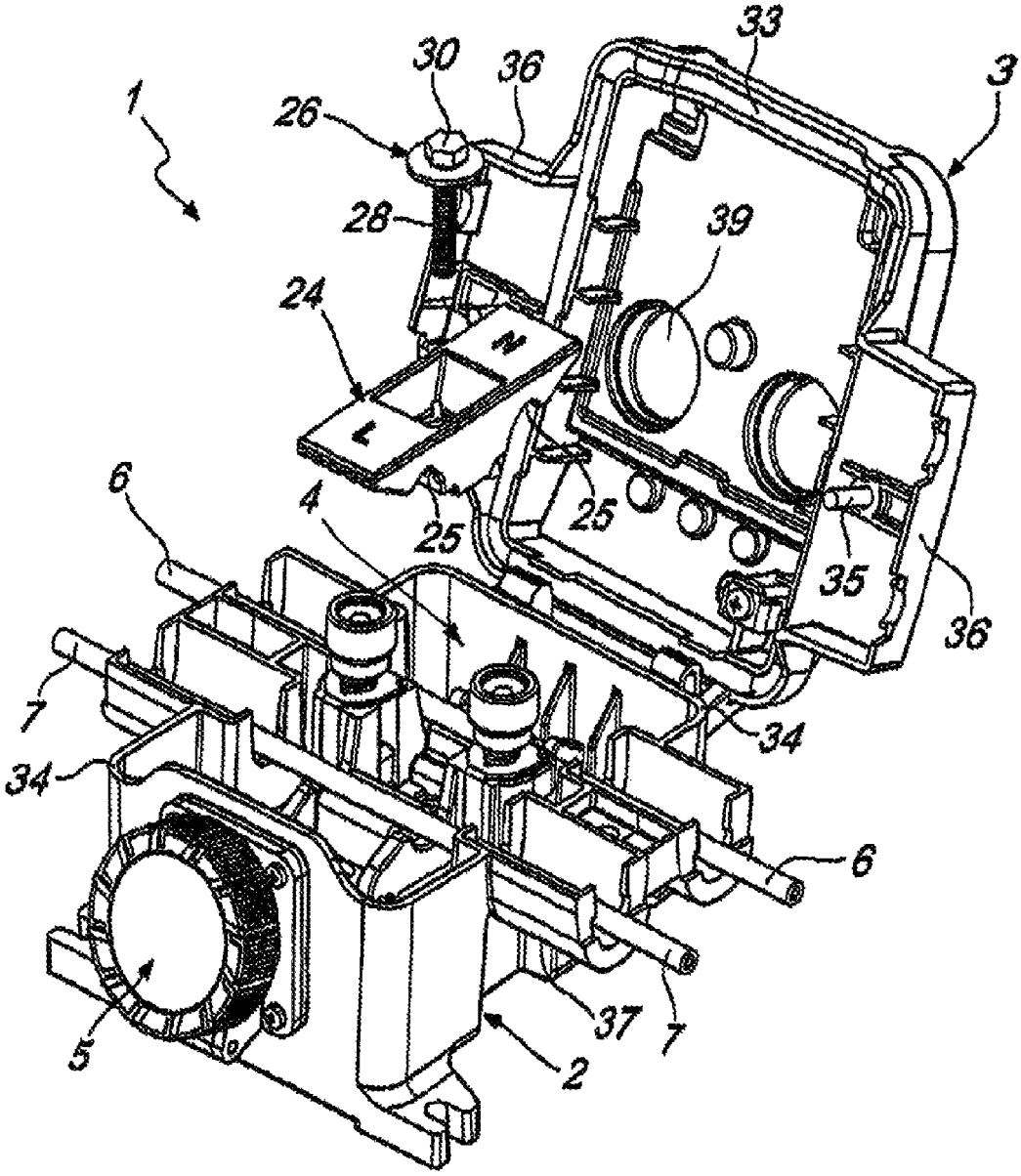
FIG. 2 is a view, similar to the preceding one, showing the box in the initial condition of installation prior to connection of the wires and prior to the application of the gaskets.
Figure 3:
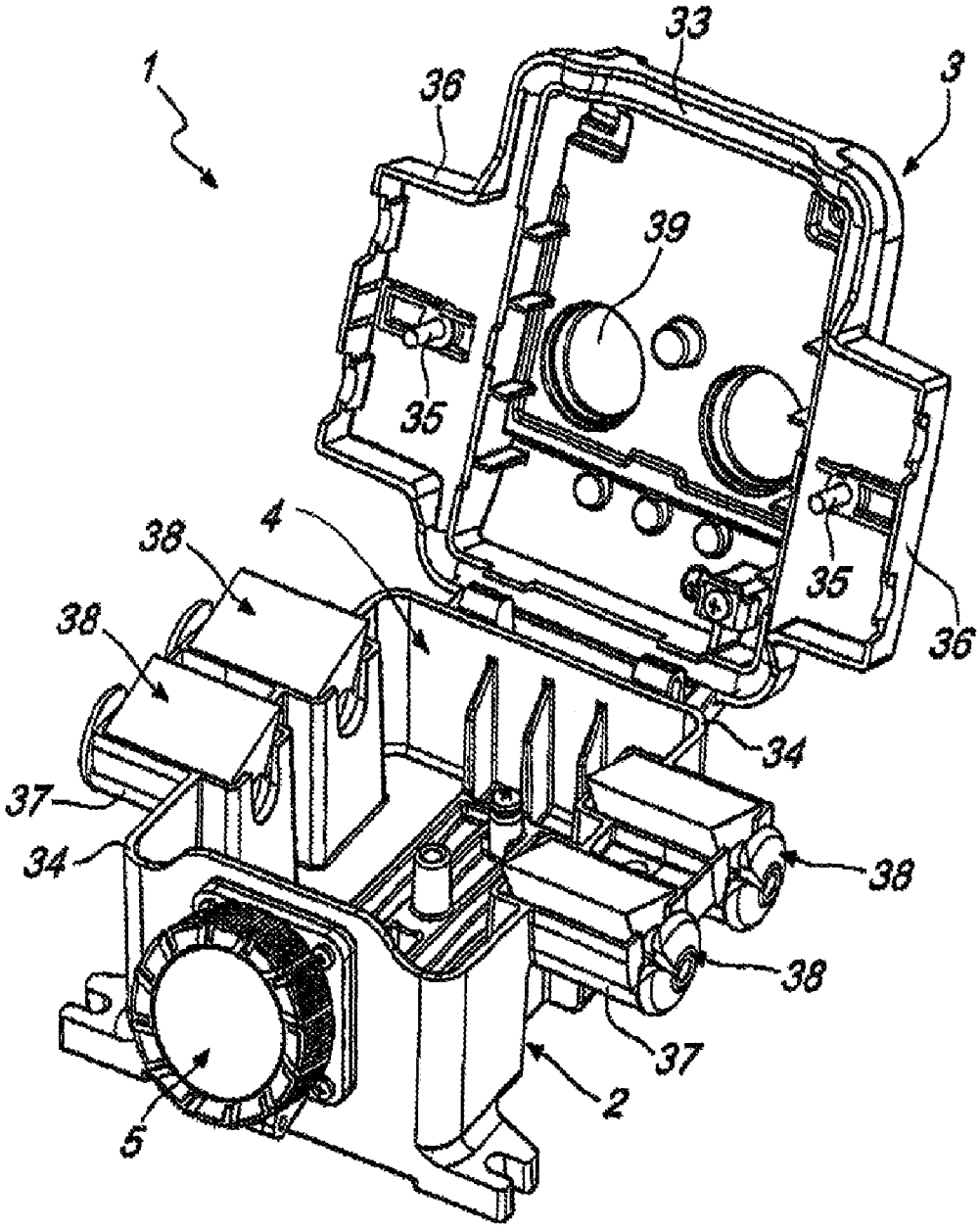
FIG. 3 is a view similar to FIG. 1 showing the box without the insulation displacement device and the connecting wires.
Figure 4:
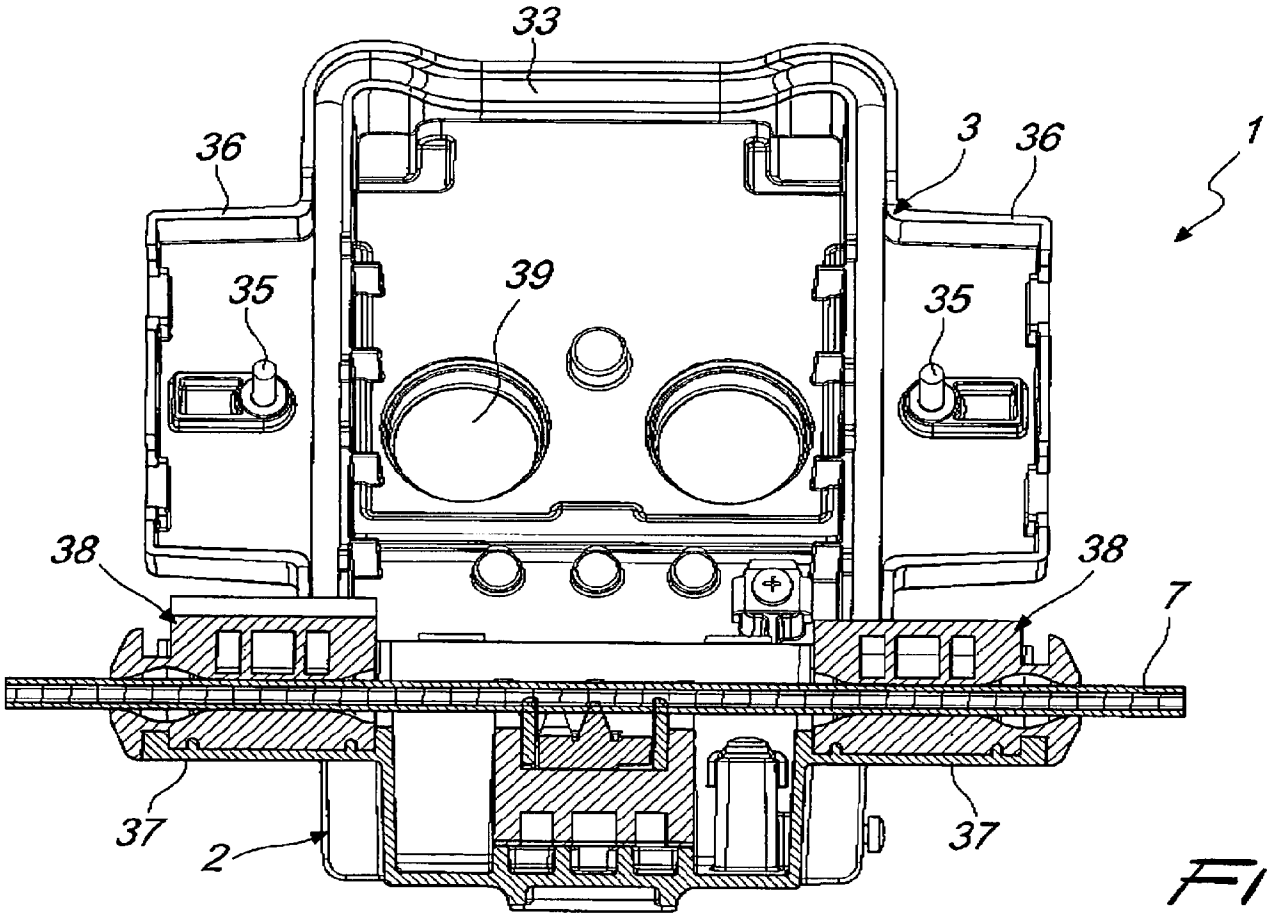
FIG. 4 is a partially sectional front view of the junction box, shown with the cover in the open position.
Figure 5:
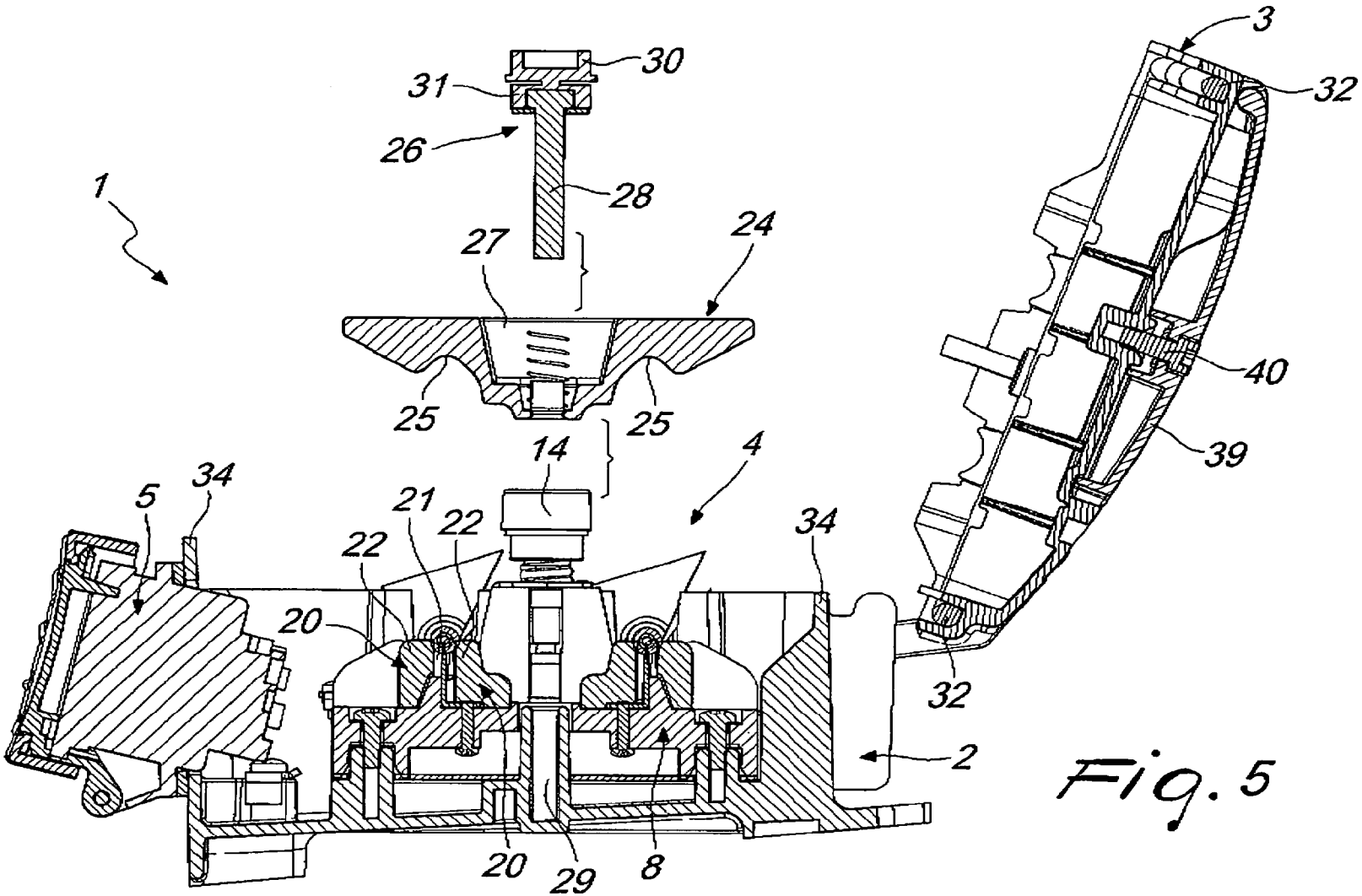
FIG. 5 is a partially sectional and exploded side view of the junction box, shown with the cover in the open position.
Figure 6:
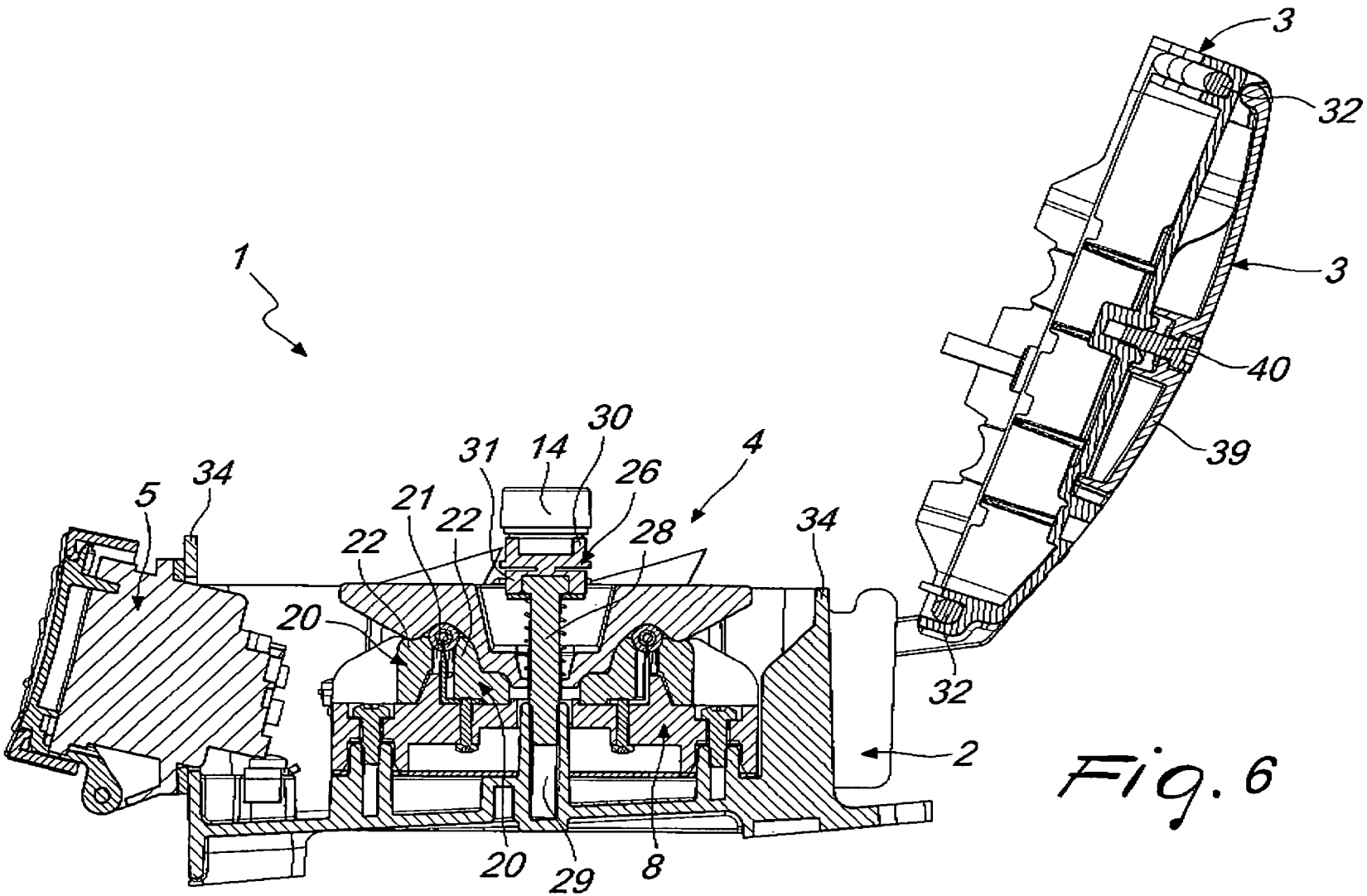
FIG. 6 is a partially sectional side view of the junction box, with the insulation displacement device in the operating position and with the cover in the open position.
Figure 7:
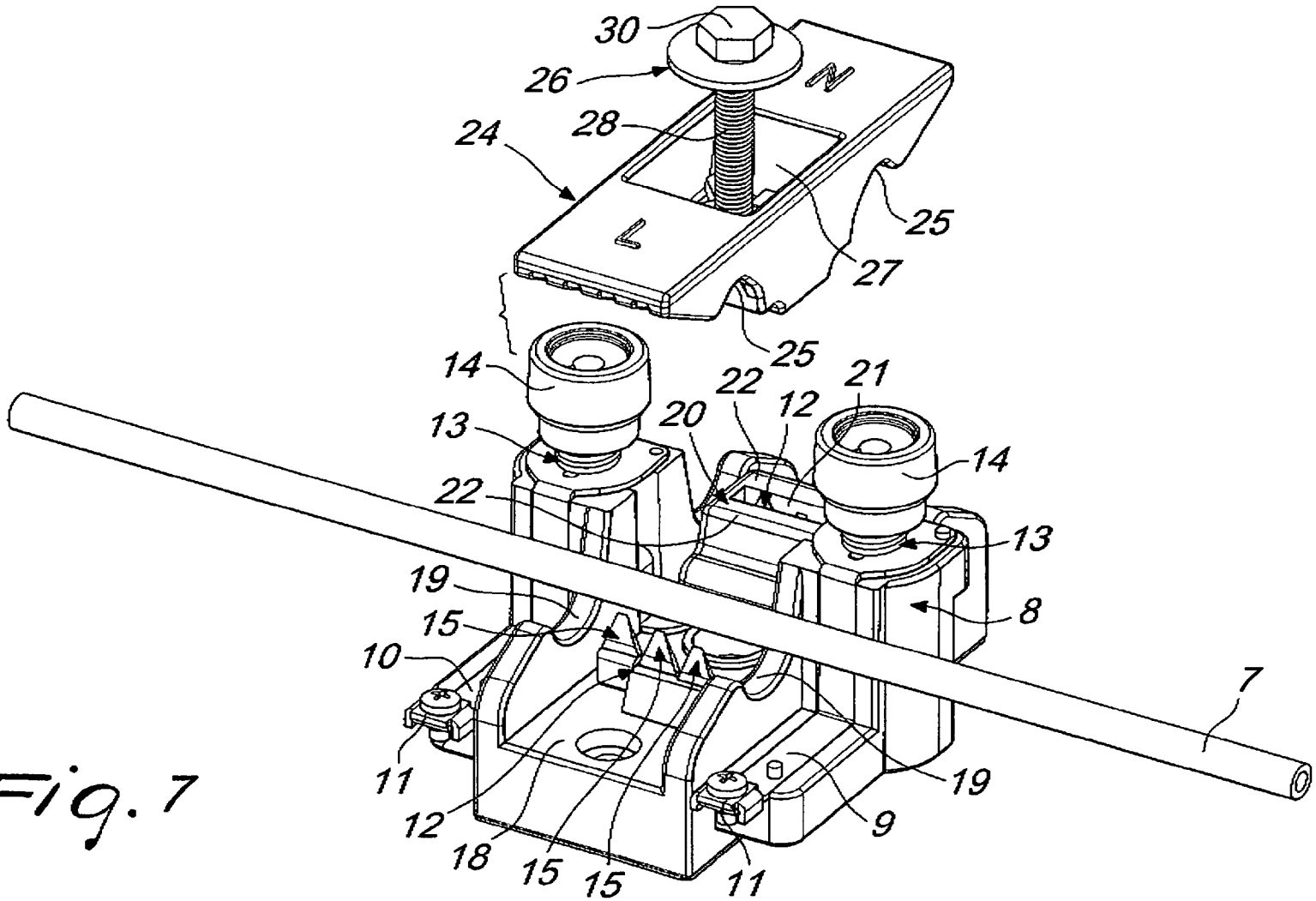
FIG. 7 is a partially exploded perspective view of the insulation displacement device.
Figure 8:
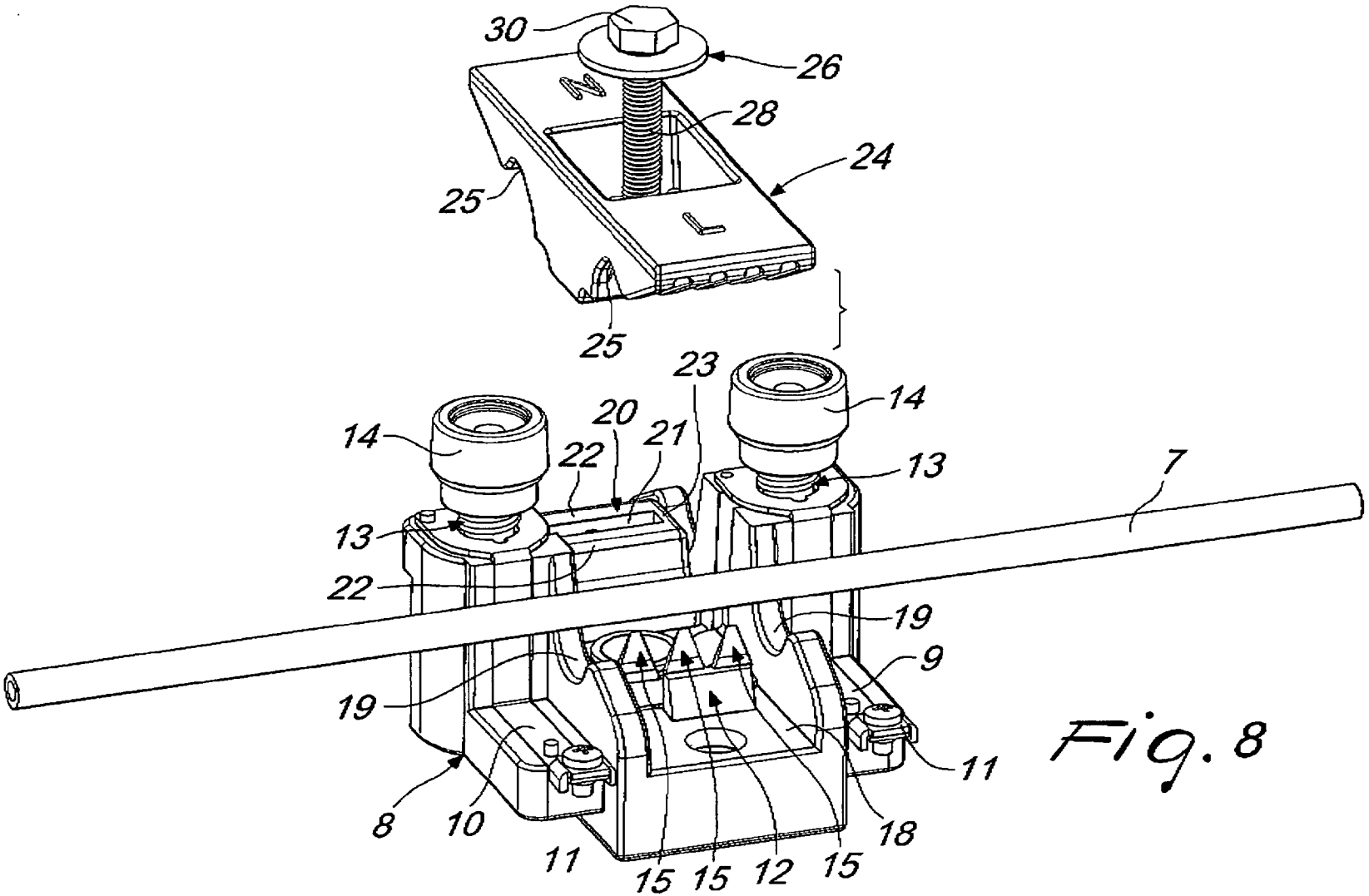
FIG. 8 is another partially exploded perspective view of the insulation displacement device.
Figure 9:
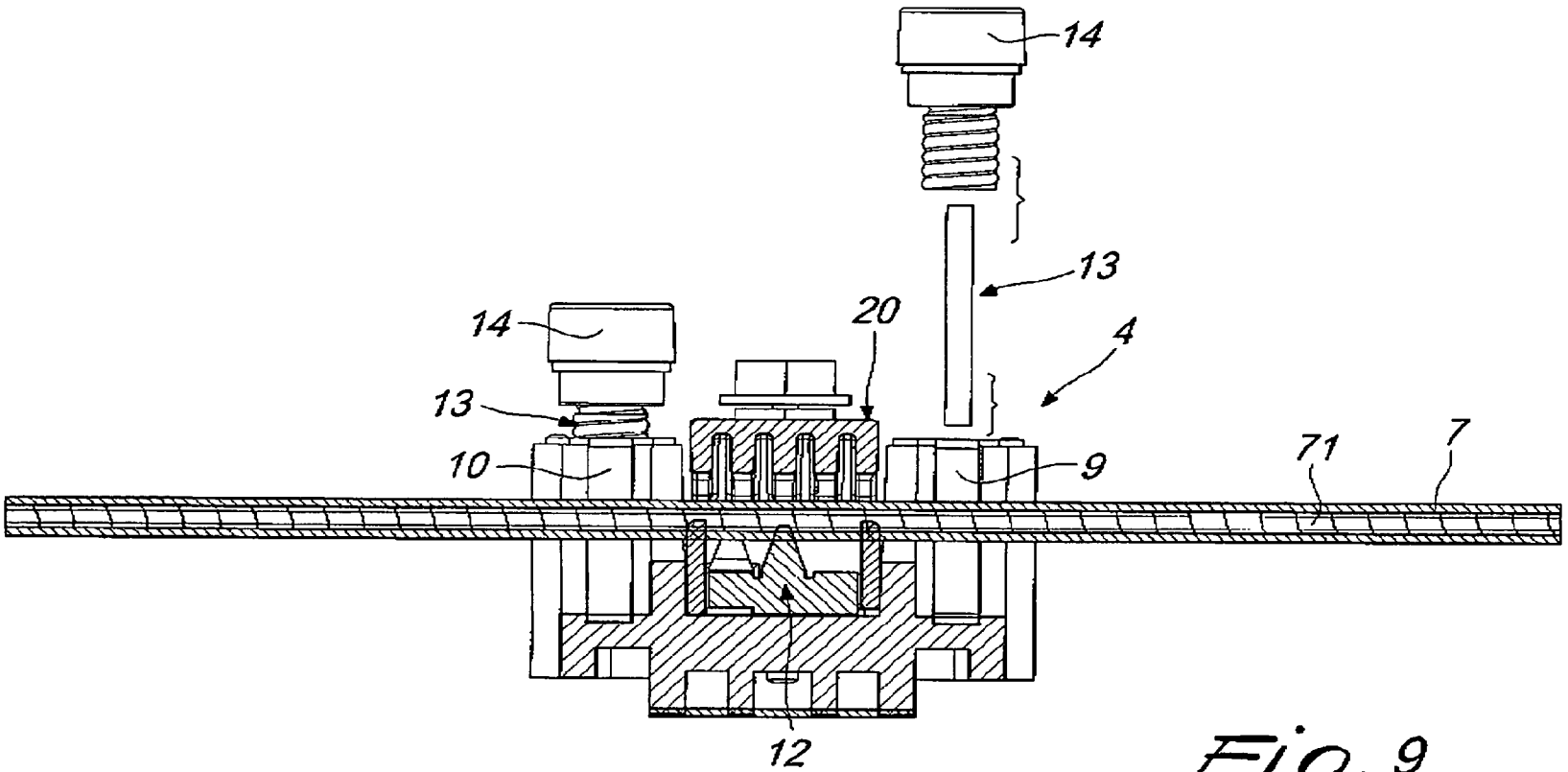
FIG. 9 is a sectional front view of the insulation displacement device in active conditions.
Figure 10:
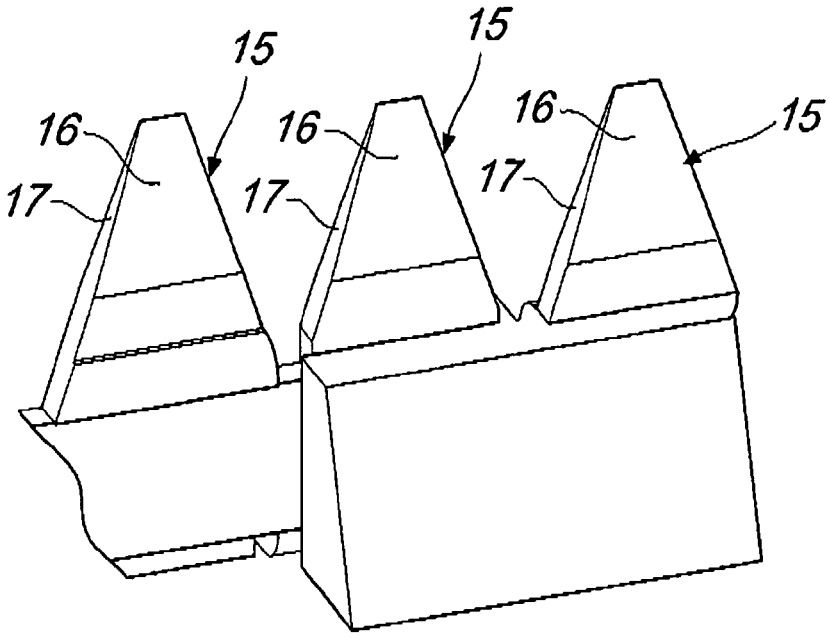
FIG. 10 is an enlarged-scale perspective view of an insulation displacement contact.

When the casing body 2 is fastened to the wall, the wires 6 and 7 are arranged at the corresponding insulation displacement devices, as shown in FIG. 2.

The gaskets 38 are applied to the wires and the connection is performed by acting on the presser 24 by screwing the locking screw 26.

By tightening the locking screw 26, with the aid for example of an electric screwdriver, the presser 24 presses each wire 6 and 7 until the spikes 15 are moved to penetrate the wire strand 71.

Due to the circular cross-section of the wire, the central spike penetrates first in the wire strand and then the lateral spikes penetrate and compact the filaments of the strand between them and the central spike.

Figure 11:
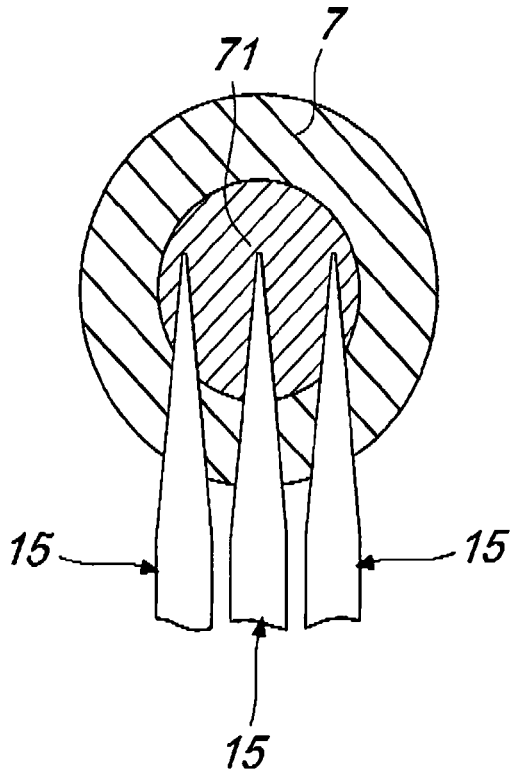
FIG. 11 is a sectional view of a wire in the region affected by the insulation displacement contact.

The offset of the spikes allows them to penetrate the wire strand 71 in such a manner as to compact between the spikes the filaments that lie between the two lateral spikes and the central spike, where the terms "central" and "lateral" refer to the position of the spikes with respect to the axis of the wire strand 71, as it is evident from the sectional view of FIG. 11.

The double taper of the spikes allows them to penetrate between the filaments of the wire strand without cutting the wire strand.

Each wire 6 and 7 is guided precisely onto the spikes 15 of the respective insulation displacement contact 12 by virtue of the shape of the presser 24, with the two symmetrical concavities 25, and by virtue of the shape of the respective rubber block 20, in which the transverse walls 23 are more easily deformable than the side walls 22, so that when the wire 6, 7 is pressed onto the block 20, the block is deformed centrally, guiding the wire to engage the spikes 15.

By acting on the only locking screw 26, the connection of both wires 6 and 7 is performed.

The operator does not have to concern himself with the amount of torque applied to the locking screw, because the correct degree of tightening is determined automatically by the breakage of the pre-weakened portion 30.

Once the connection of the wires 6 and 7 to the respective insulation displacement contacts 12 has been performed, it is possible to close the cover 3, tightening the closure screws 35, which are advantageously arranged in a central position between each pair of gaskets 38 and therefore act in the most highly stressed region, because the gaskets 38 must be compressed in order to retract into their respective seats.

Installation of the junction box 1 is thus completed and it is sufficient to connect the lamp, not shown in the figures, by means of a connector to be applied to the socket 5.

In practice it has been found that the invention achieves the intended aim and objects, providing a junction box that is installed easily and shorter than conventional systems and at the same time offers increased safety.

Installation of the junction box according to the present invention is extremely faster and easier than conventional boxes. The operator in fact saves approximately 20 to 30 minutes for each box to be installed.

This is due to the fact of having to act on a single presser that simultaneously provides the insulation displacement contact on both wires.

The shape of the insulation displacement contact 12, of the respective block 20 and of the concavity 25 of the presser 24, also allows to use the same junction box for wires having very different cross-sections, comprised between 4 and 35 $mm^2$. Such a range was covered by three to four conventional boxes of different sizes.

In case of anomaly in the operation of the lamp connected thereto, the fuses immediately isolate the lamp from the wires 6 and 7, thus ensuring continuity of the power supply on the line.

Even in case of fire and of possible destruction of the casing body, the wires are not interrupted, and there is no interruption of the power supply line. Moreover, the ceramic base ensures that the wires 6 and 7 are always in a mutually separate position, avoiding short circuits.

During normal operation of the junction box, the degree of protection offered (IP 66) ensures that dust and water do not penetrate in the box even during the washing of the tunnel, which is performed with pressurized water jets.

This application claims the priority of Italian Patent Application No. MI2009A001720, filed on Oct. 8, 2009, the subject matter of which is incorporated herein by reference.

The invention claimed is:

1. A junction box particularly for lighting lines for tunnels, comprising a casing body provided with a cover, wherein: said body comprises an electrical socket; a junction device inside said casing body connects said electrical socket to a pair of power supply wires of a power supply line at said junction box; the junction device comprises one or more insulation displacement contacts; and each insulation displacement contact engages a respective power supply wire without cutting it, each said insulation displacement contact including multiple spikes longitudinally arranged along the direction of the respective power supply wire, said spikes being mutually offset longitudinally, said spikes also being mutually offset transversely such that each of said spikes is arranged in a different plane from the other spikes, said spikes being arranged in an elastic member with differentiated deformation.

2. The box according to claim 1, wherein: each of said spikes has a double taper, said double taper including a transverse taper and a longitudinal taper.

3. The box according to claim 1, wherein: said elastic member with differentiated deformation is constituted by a rubber block, which has a central open cavity that accommodates said insulation displacement contact; said rubber block has a pair of side walls which are connected to transverse walls which are more easily deformable than said side walls, so that when said respective power supply wire is pressed against said block, it is deformed centrally, guiding said respective power supply wire so as to engage said spikes.

4. The box according to claim 1, wherein: said power supply wires are at least two and run parallel to each other; said wires are pressed onto the respective insulation displacement contacts by means of a single presser constituted by an element that has two symmetrical concavities that correspond to the position of said wires; said presser has a single locking screw; said locking screw comprises a head which engages a seat of said presser; said locking screw comprises a threaded stem that engages a threaded hole provided in a base that is jointly connected to said casing body and supports said insulation displacement contacts.

5. The box according to claim 4, wherein: said locking screw comprises a head; said head comprises a pre-weakened portion that can be engaged by a tool; said pre-weakened portion is provided in such a manner that it breaks when the torque applied by said tool during tightening exceeds a selected value, so as to allow correct tightening of the locking screw even without the aid of a torque tool; said head comprises a fixed portion that can be engaged by a tool also after said pre-weakened portion has been removed.

6. The box according to claim 4, wherein: said base is made of ceramics and supports a pair of contoured contacts; said contacts have respective terminals for connection to said socket by means of wired conductors; said contacts are furthermore connected to respective said insulation displacement contacts with the interposition of respective fuses, which are inserted in seats provided in said base and can be accessed by means of a screw-type knob; the connection between each one of said insulation displacement contacts and said socket is provided by means of a respective one of said fuses; each one of said insulation displacement contacts is arranged in a seat that is formed by two saddles which are an integral part of said ceramic base.

7. The box according to claim 1, wherein: said cover is closed hermetically on said casing body by means of the interposition of a gasket that runs along the perimeter of said cover and is accommodated in a perimetric seat so as to be compressed by an edge of said body when said cover is locked on said body by virtue of two closure screws; said closure screws are provided in two wings of said cover, which correspond to two wings of said casing body in order to form a pair of seats for a corresponding number of gaskets of said wires; said gaskets surround both entry and exit sections of the wires in the casing body and are locked on said wires by tightening said closure screws.

8. The box claim 1, wherein said cover has a cap that allows access to knobs of respective fuses in order to optionally replace said fuses without necessarily removing said cover in order to open said box.

* * * * *